United States Patent [19]

Kawabe

[11] Patent Number: 4,944,708

[45] Date of Patent: Jul. 31, 1990

[54] MOVING DOLL TOY

[75] Inventor: Haruo Kawabe, Misato, Japan

[73] Assignee: Takara Co., Ltd., Tokyo, Japan

[21] Appl. No.: 187,379

[22] Filed: Apr. 28, 1988

[30] Foreign Application Priority Data

Feb. 29, 1988 [JP] Japan ..... 63-26354[U]

[51] Int. Cl.[5] ..... A63H 11/18; A63H 30/04

[52] U.S. Cl. ..... 446/175; 446/355

[58] Field of Search ..... 446/175, 354, 356, 355, 446/285, 276, 280, 288, 294, 298

[56] References Cited

U.S. PATENT DOCUMENTS

| | | | |
|---|---|---|---|
| 2,804,720 | 9/1957 | Olson | 446/356 X |
| 4,006,555 | 2/1977 | England et al. | 446/354 X |
| 4,245,430 | 1/1981 | Hoyt | 446/175 |
| 4,305,222 | 12/1981 | Terzian et al. | 446/288 |
| 4,614,504 | 9/1986 | Yamasaki | 446/356 |

FOREIGN PATENT DOCUMENTS

| | | | |
|---|---|---|---|
| 1004080 | 3/1952 | France | 446/356 |
| 415622 | 9/1947 | Italy | 446/356 |
| 243729 | 11/1925 | United Kingdom . | |
| 300198 | 7/1929 | United Kingdom . | |
| 794163 | 4/1958 | United Kingdom . | |
| 2022426 | 12/1979 | United Kingdom . | |
| 2058589 | 4/1981 | United Kingdom | 446/175 |

*Primary Examiner*—Mickey Yu

*Attorney, Agent, or Firm*—Price, Gess & Ubell

[57] ABSTRACT

A moving doll toy capable of positively and repeatedly carrying out walking action and being protected from damage due to misoperation. The moving doll toy includes each pair of arms and legs pivotally connected to a body so as to be pivotally moved in forward and backward directions and a driving structure. The driving structure includes a motor, a gear transmission mechanism connected to the motor, each pair of first and second cams connected to an output shaft of the gear transmission mechanism, and each pair of first and second connecting members engaged with the first and second cams and operatively connected to the arms and legs, respectively.

7 Claims, 2 Drawing Sheets

MOVING DOLL TOY

BACKGROUND OF THE INVENTION

1. Field of the Invention

This invention relates to a moving doll toy, and more particularly to a moving doll toy which is adapted to carry out walking action.

2. Description of the Prior Art

In general, a moving doll toy is acceptable to infants and children. Accordingly, various kinds of moving doll toys, particularly, walking doll toys have been conventionally proposed. However, the conventional moving doll toy generally fails to accurately carry out moving action and tends to drive a motor under high load. Also, the conventional moving doll toy causes damage to a certain moving section due to misoperation and fails to positively repeat moving action.

Accordingly, it would be highly desirable to develop a moving doll toy which is capable of positively and repeatedly carrying out moving or walking action, driving a motor under low load and preventing damage to a certain moving section due to misoperation.

SUMMARY OF THE INVENTION

Generally speaking, in accordance with the present invention, a moving doll toy is provided. The moving doll toy generally includes a head, a body, a pair of arms connected to the body, a pair of legs connected to the body, and a driving structure arranged within the body. The arms and legs are pivotally connected to the body so as to be pivotally moved in forward and rearward directions. The driving mechanism includes a motor, a gear transmission mechanism connected to the motor, first and second cam means connected to the gear transmission mechanism, and first and second connecting members engaged with the first and second cam means and operatively connected to the arms and legs, respectively.

Accordingly, it is an object of the present invention to provide a moving doll toy which is capable of accurately carrying out walking action.

It is another object of the present invention to provide a moving doll toy which is capable of carrying out moving action under low load.

It is a further object of the present invention to provide a moving doll toy which is capable of preventing damage due to misoperation.

It is still another object of the present invention to provide a moving doll toy which is capable of positively repeating moving action.

It is yet another object of the present invention to provide a moving doll toy which is capable of being readily assembled.

It is still a further object of the present invention to provide a moving doll toy which is capable of carrying out stable walking action.

It is yet a further object of the present invention to provide a moving doll toy which is capable of accomplishing the above-described objects with a simple structure.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings; wherein.

DETAILED DESCRIPTION OF THE PREFERRED EMBODIMENT

Now, a moving doll toy according to the present invention will be described hereinafter with reference to the accompanying drawings.

Figure 1:
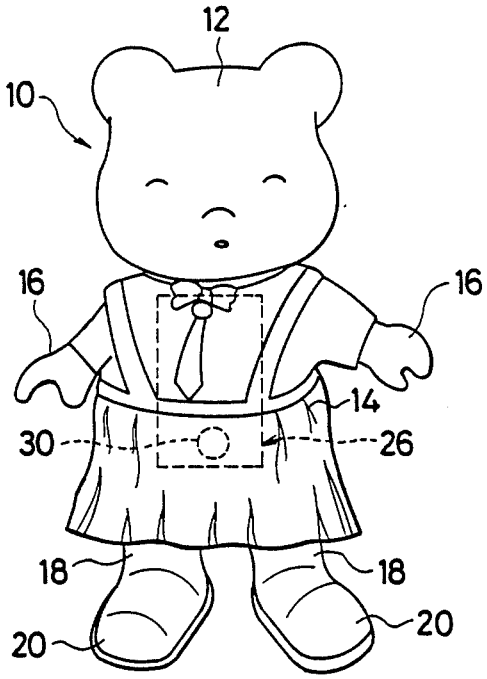
FIG. 1 is a schematic perspective view showing an embodiment of a moving doll toy according to the present invention.

FIG. 1 shows an embodiment of a moving doll toy according to the present invention. A moving doll toy of the illustrated embodiment generally designated by reference numeral 10 is in the form of a bear and generally comprises a head 12, a body 14, a pair of arms 16 connected to the body 14 so as to be pivotally moved rearward and forward, and a pair of legs 18 connected to the body 14 so as to be pivotally moved rearward and forward and each provided with a foot 20.

Figure 2:
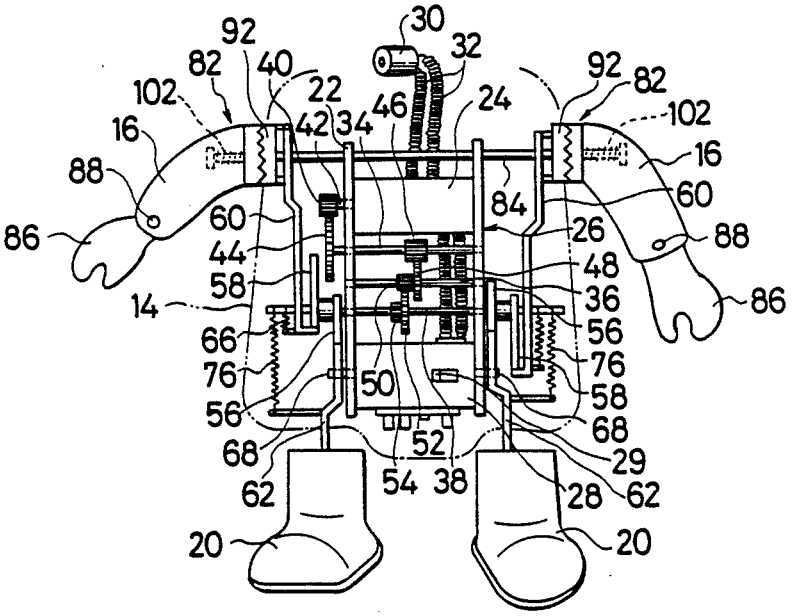
FIG. 2 is a schematic front elevation view showing the driving structure of the moving doll toy shown in FIG. 1.
Figure 3:
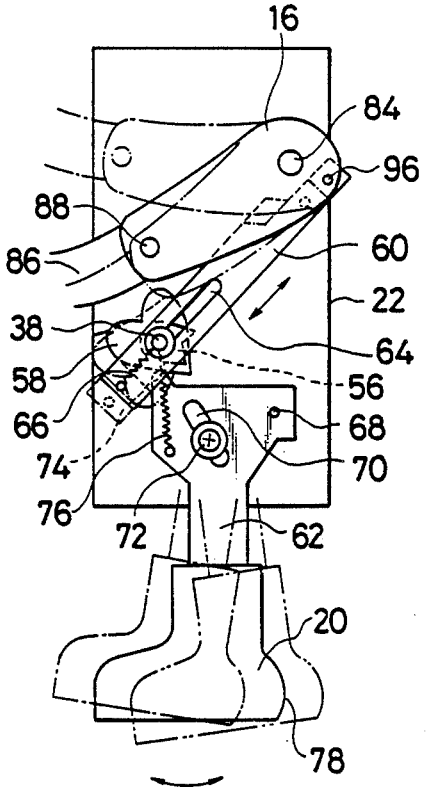
FIG. 3 is a side elevation view of the driving structure shown in FIG. 2.
Figure 4:
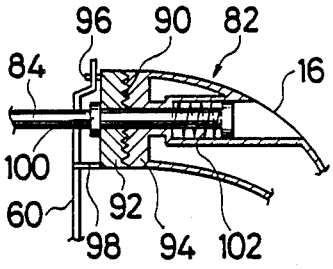
FIG. 4 is a sectional view showing the manner of connection between an arm and an upper connecting plate member.

The moving doll toy 10 also includes a driving structure arranged within the doll toy 10, which is constructed in such a manner as shown in FIGS. 2 to 4. More particularly, the driving structure includes a frame 22 arranged in the body 14, and a motor 24, a gear transmission mechanism 26 and a power source section 28 each supported on the frame 22. In the illustrated embodiment, the motor 24 and power source 28 are arranged so as to be vertically spaced from each other with the gear transmission mechanism 26 being interposed therebetween. The power source section 28 has a power source such as a cell or the like received therein and is provided with a switch 29.

In the moving doll toy 10 of the illustrated embodiment, the driving structure may include a sensor 30 which may detect a physical quantity such as sound or light. For this purpose, a sound sensor or a photo sensor may be used as the sensor 30 and arranged at a portion of the body 14 corresponding to a navel. The sensor 30 is electrically connected to the motor 24 and power source section 28 through lead wires 32, so that it may actuate the motor when it detects a physical quantity. A circuit for causing the sound sensor 30 to actuate the motor 24 when it detects sound may utilize a transistor or the like. Such a circuit is widely known in the art.

The driving structure further includes a first support shaft 34, a second support shaft 36 and a third support shaft 38 supported on the frame 22 in order from above so as to laterally extend in parallel fashion to one another. The first support shaft 34 is positioned right below the motor 24 and arranged in a manner to terminate at one end thereof on one side of the frame 22 and outwardly extend at the other end thereof from the other side of the frame 22. The second support shaft 36 is supported on the frame 22 so as to terminate at both ends thereof on both sides of the frame 22. The third support shaft 38 is supported on the frame 22 so as to outwardly extend at both ends thereof from both sides of the frame 22.

The gear transmission mechanism 26, as shown in FIG. 2, includes a pinion 40 fixed on an output shaft 42 of the motor 24 and a spur gear 44 mounted on the other end of the first support shaft 34 projecting from the other side of the frame 22 and engaged with the pinion 40 so as to transmit rotation of output shaft 42 of the motor 24 through the pinion 40 and the spur gear 44 to the first support shaft 34. The gear transmission mechanism 26 also includes a pinion 46 fixed on the first support shaft 34 and a spur gear 48 securely mounted on the second support shaft 36 and engaged with the pinion 46 to transmit rotation of the first support shaft 34 through the pinion 46 and spur gear 48 to the second support shaft 36. Rotation of the second support shaft 36 is transmitted to the third support shaft 38 through engagement between a pinion 50 fixed on the second support shaft 36 and a spur gear 52 fixed on the third support shaft 38. Thus, it will be noted that the first support shaft 34 and third support shaft 38 serve as an input shaft and an output shaft of the gear transmission mechanism 26, respectively. Reference numeral 54 designates a pinion mounted on the third support shaft 38.

On each opposite portion of the third support shaft or output shaft 38 projecting from both sides of the frame 22 are fixed a first cam or outer cam 58 and a second cam or inner cam 56 in a manner to be spaced from each other through a spacer. In the illustrated embodiment, the inner cams 56 are each formed into a substantially round-bottomed chopped wave shape so as to comprise a semicircular cam body and a triangle projection formed on a central portion of a flat surface of the cam body, as shown in FIG. 3. The outer cams 58 are each formed into substantially a heart shape.

In addition, the driving structure, as shown in FIGS. 2 and 3, includes a pair of first connecting members or upper connecting plate members 60 slidably arranged outside the frame 22 so as to extend obliquely and a pair of second connecting members or lower connecting plate members 62 arranged between the upper connecting plate members 60 and the frame 22 so as to pivotally move in rearward and forward directions. The upper connecting plate members 60 are each formed with a guide slit 64 extending in a longitudinal direction thereof, in which the third support shaft 38 is loosely fitted. Each of the upper connecting plate members 60 is inwardly bent at a lower end thereof so as to be abuttedly engaged with the outer cam 58. This results in the upper connecting plate member 60 being obliquely slid within a range of the length of the slit 64 due to rotation of the outer cam 58. Between a lower or proximal end of each of the upper connecting plate members 60 and the third support shaft 38 is fixedly interposed an elastic member or compression spring 66 which serves to constantly force the upper connecting plate member 60 in an obliquely upward direction to ensure abutted engagement of the plate member 60 with the outer cam 58.

The lower connecting plate members 62, as shown in FIG. 3, are each pivotally supported at one side of an upper portion thereof through a support shaft 68 on the frame 22 and formed at a center of their upper portions with an obliquely extending guide slit 70, in which a rod 72 arranged so as to project outward from each side of the frame 22 is loosely fitted. Also, each of the lower connecting plate members 62 is provided at the other side of its upper portion with a projection 74 which is abuttedly engaged with the inner cam 56. This results in each of the lower connecting plate members 62 being pivotally moved to the back and front of the doll toy about the support shaft 68 due to rotation of the inner cam 56. Such pivotal movement of the member 62 is carried out within a range of the length of the guide slit 70. Between each end of the third support shaft 38 and the projection 74 of each of the lower connecting plate members 62 is fixedly interposed an elastic member or compression spring 76 which serves to upwardly force the lower connecting plate member 62 to pivotally move about the support shaft 68. Also, the compression spring 76 acts to maintain the engagement between the inner cam 56 and the projection 74 of the plate member 62.

Figure 5:
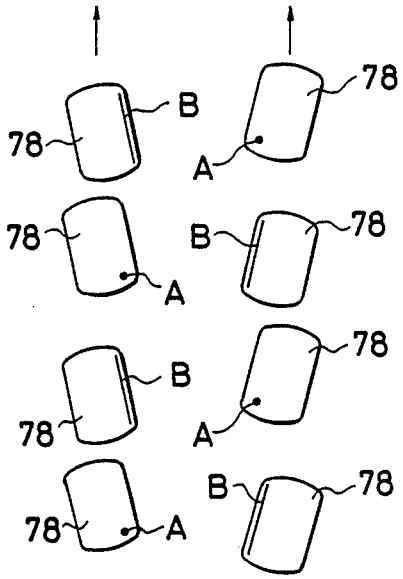
FIG. 5 is a schematic view showing the manner of contact of the soles of the feet of the moving doll toy shown in FIG. 1 with a surface on which the toy is placed.

Each of the lower connecting plate members 62 serves as the leg 18 of the doll 10 and the foot 20 is attached to a lower portion of each of the plate members 62. The feet 20 have soles 78 formed to alternately carry out point contact and line contact with respect to a surface on which the doll is placed, as indicated at reference characters A and B in FIG. 5, respectively. More particularly, any one of the soles 78 carries out point contact A while the other sole carries out line contact B.

The upper connecting plate members 60 are each connected to the arm 16 through a connection part which is provided with a slip clutch mechanism 82. Each of the arms 16 is loosely fitted at a proximal end thereof on each end of a support shaft 84 mounted on the frame 22 above the motor 24 so as to laterally extend therethrough and has a hand 86 connected to a distal end thereof through a pin 88 in a manner to be bendable or pivotable about the pin 88. The proximal end of each of the arms 16, as shown in FIG. 4, is formed with an unevenness 90. Correspondingly, on the support shaft 84 is loosely fitted a pair of circular members 92, each of which is arranged opposite to the proximal end of each of the arms 16 and formed on an outer surface thereof with an unevenness 94 releasably engaged with the unevenness 90 of the arm 16. Each of the circular members 92 is securely connected or attached to a distal end of the upper connecting member 60 through a first rod 96 and a second rod 98 respectively provided at an upper periphery and a lower periphery of an inner surface of the circular member 92, as shown in FIG. 4. On the support shaft 84 are fixedly mounted or fitted a pair of stoppers 100 each of which is engaged with each of the circular members 92 to prevent it from inwardly moving. Also, the support shaft 84 has a pair of elastic members 102 such as springs fitted on both ends thereof which serve to constantly force the arms 16 toward the circular members 92 to ensure abutment or engagement between the unevenness 90 of each of the arms 16 and the unevenness 94 of the corresponding circular member 92. Such construction effectively prevents damage of the arm 16 even when overload is applied to the pivotally moving arm 16, because the unevennesses 90 and 94 repeatedly carry out engagement and disengagement therebetween to function as a slip clutch mechanism when the overload occurs.

Now, the manner of operation of the moving doll toy 10 of the illustrated embodiment constructed as described above will be described hereinafter.

First, when the sound sensor 30 detects sound while the main switch 29 provided on the power source section 28 is kept turned on, the motor 24 is driven to actuate the gear transmission mechanism 26. This causes the upper and lower connecting plate members 60 and 62 to be actuated through the outer and inner cams 58 and 56 mounted on the third support shaft 38, respectively, resulting in the arms 16 connected to the upper plate members 60 and the legs 18 connected to the lower plate members 62 being concurrently, pivotally moved.

Pivotal movement of the legs 18 is alternately and repeatedly carried out in backward and forward directions, so that the walking action of the doll toy may be accomplished. Also, the soles 78 of the feet 20 alternately carry out point contact and line contact with respect to a surface on which the doll toy is placed, resulting in frictional resistance between the soles 78 and the surface being decreased to a degree which significantly reduces the load applied to the motor 24. Also, the illustrated embodiment effectively prevents damage of the arms 16 even when they are moved by misoperation, because the slip clutch mechanism 82 is provided at the connection part between each arm 16 and each upper connecting plate member 60. Further, the arms 16 and legs 18 are constantly forced to return to their original positions by the elastic members 66 and 76, so that the doll toy may positively repeat its moving action. Furthermore, the power source section 28 which is heavy is arranged at a lower section of the body 14, so that the walking action of the doll toy may be stably carried out.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. An improved driving structure for use with a moving doll having a body, the body having a left side and a right side, and upon which body a left arm, a right arm, a left leg, and a right leg are pivotally connected, the improvement comprising:

a frame located in the body, the frame having a left side and a right side, a motor mounted on the frame, a gear transmission mechanism mounted on the frame and connected to the motor, the gear transmission mechanism having a left side output shaft and a right side output shaft;

a first pair of cam means for providing rotating camming surfaces of a predetermined shape, one of the first cam means being mounted to the left side output shaft and the other of the first cam means being mounted to the right side output shaft;

a first pair of connecting members, each connecting member having an arm side that is connected to one of the arm pairs and a camming side that engages the camming surface of a corresponding one of the first pair of cam means;

a second pair of cam means for providing rotating camming surfaces of a predetermined shape, one of the second cam means being mounted to the left side of the output shaft and the other of the second cam means being mounted to the right side of the output shaft;

a second pair of connecting members, each connecting member having a leg side that is connected to one of the legs and a camming side that engages the camming surface of a corresponding one of the second pair of cam means; and biasing means, located between the left and right output shafts and the corresponding camming side of each connecting member, for biasing the camming side of each connecting member against its corresponding cam means whereby the arms and legs of the moving doll may be moved in a predetermined fashion in accordance with the predetermined shapes of the cam means.

2. An improved driving structure as defined in claim 1, wherein said arms are connected to said first connecting members through connections each provided with a slip clutch mechanism.

3. An improved driving structure as defined in claim 1, wherein said legs are provided with feet of which soles are formed so as to alternately carry out point contact and line contact with respect to a surface on which said toy is placed.

4. An improved driving structure as defined in claim 3, wherein said driving structure further includes a power source section connected to said motor, said power source section being arranged at a lower section of said body.

5. An improved driving structure as defined in claim 1 wherein said driving structure further includes a sensor which detects a physical quantity and provides an output in response thereto, said motor operating in response to said output.

6. An improved driving structure as defined in claim 5, wherein said sensor is a sound sensor.

7. A moving doll toy comprising a body; a head mounted on said body; a pair of arms connected to said body; a pair of legs connected to said body; a driving structure arranged in said body; said arms and legs being pivotally connected to said body so as to be pivotally moved in forward and backward directions; said driving structure including a power supply section, a motor connected to said power supply section, a gear transmission mechanism connected to said motor and including an output shaft, a first and second pair of cams, each pair of first and second cams mounted on said output shaft of said gear transmission mechanism, a first and second pair of connecting members, each pair of first and second connecting members respectively engaged with one of said first and second pair of cams and operatively connected to one of said pair of arms and legs, respectively, a slip clutch mechanism provided at a connection between each of said arms and each of said first connecting members, and elastic members fixedly interposed between said first and second connecting members and said output shaft of said gear transmission mechanism to constantly force said first and second connecting members to return to their original positions.

* * * * *